US006368233B1

(12) United States Patent
Chen

(10) Patent No.: US 6,368,233 B1
(45) Date of Patent: Apr. 9, 2002

(54) HEAD OF WOODEN GOLF CLUB

(76) Inventor: Archer C. C. Chen, No. 501, 28th Road, Taichung Industrial Park, Taichung (TW)

( * ) Notice: Subject to any disclaimer, the term of this patent is extended or adjusted under 35 U.S.C. 154(b) by 0 days.

(21) Appl. No.: 09/478,503

(22) Filed: Jan. 6, 2000

(51) Int. Cl.[7] ..... A63B 53/04
(52) U.S. Cl. ..... 473/342; 473/349; 473/345
(58) Field of Search ..... 473/131, 324, 473/345, 346, 349, 290, 291, 409, 330, 348, 350, 342

(56) References Cited

U.S. PATENT DOCUMENTS 4,465,221 A * 8/1984 Schmidt
5,658,207 A * 8/1997 Aizawa
5,704,850 A * 1/1998 Shieh
5,755,627 A * 5/1998 Yamazaki
5,967,904 A * 10/1999 Nagai
5,993,329 A * 11/1999 Shieh
6,071,200 A * 6/2000 Song
6,089,070 A * 7/2000 Hancock

* cited by examiner

*Primary Examiner*—Sebastiano Passaniti
(74) *Attorney, Agent, or Firm*—Browdy and Neimark

(57) ABSTRACT

A wooden golf club head comprises a main body and an arcuate shell. The main body is made of stainless steel and is provided with an arcuate notch. The arcuate shell is joined with the arcuate notch of the main body by welding and is formed of an arcuate piece of stainless steel, and a main piece of titanium. The arcuate piece is provided with a hollow interior in which the main piece is welded.

5 Claims, 5 Drawing Sheets

HEAD OF WOODEN GOLF CLUB

FIELD OF THE INVENTION

The present invention relates generally to a wooden golf club, and more particularly to a head of the wooden golf club.

BACKGROUND OF THE INVENTION

The head of a conventional wooden golf club is of a hollow construction and is formed of two or three shell members which are joined together by welding. As shown in FIG. 1, a typical head of the conventional golf club is made by casting or forging and is composed of a base shell 91, a front shell 92, and a top shell 93, which are joined together by welding. The head has a center of gravity, which is preferably kept as low as possible so as to enable the head to hit a ball to fly as far as possible. Such a feat may be attained by making use of the top shell 93 of a light metal, such as titanium, the base shell 91 and the front shell 93 which are made of a heavy metal, such as stainless steel. However, such a combination as described above is technically infeasible in view of the fact that the welding of titanium must be done in a vacuum booth or in a booth containing an inert gas.

SUMMARY OF THE INVENTION

It is therefore the primary objective of the present invention to provide a wooden golf club head which has a low center of gravity.

It is another objective of the present invention to provide a wooden golf club head which is cost-effective and low in rejection rate.

In keeping with the principle of the present invention, the foregoing objectives of the present invention is attained by a wooden golf club head comprising a shell-like main body having a notch, and an arcuate top shell corresponding in shape to the notch of the main body. The main body and the top shell are made of different materials. The top shell is formed of a main piece and an arcuate piece. The main piece is made of a material different from the material of which the main body is made. The arcuate piece is made of a material identical to the material of which the main body is made. The arcuate piece is fastened with the main piece by welding. The top shell is joined with the notch of the main body by welding.

The foregoing objectives, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
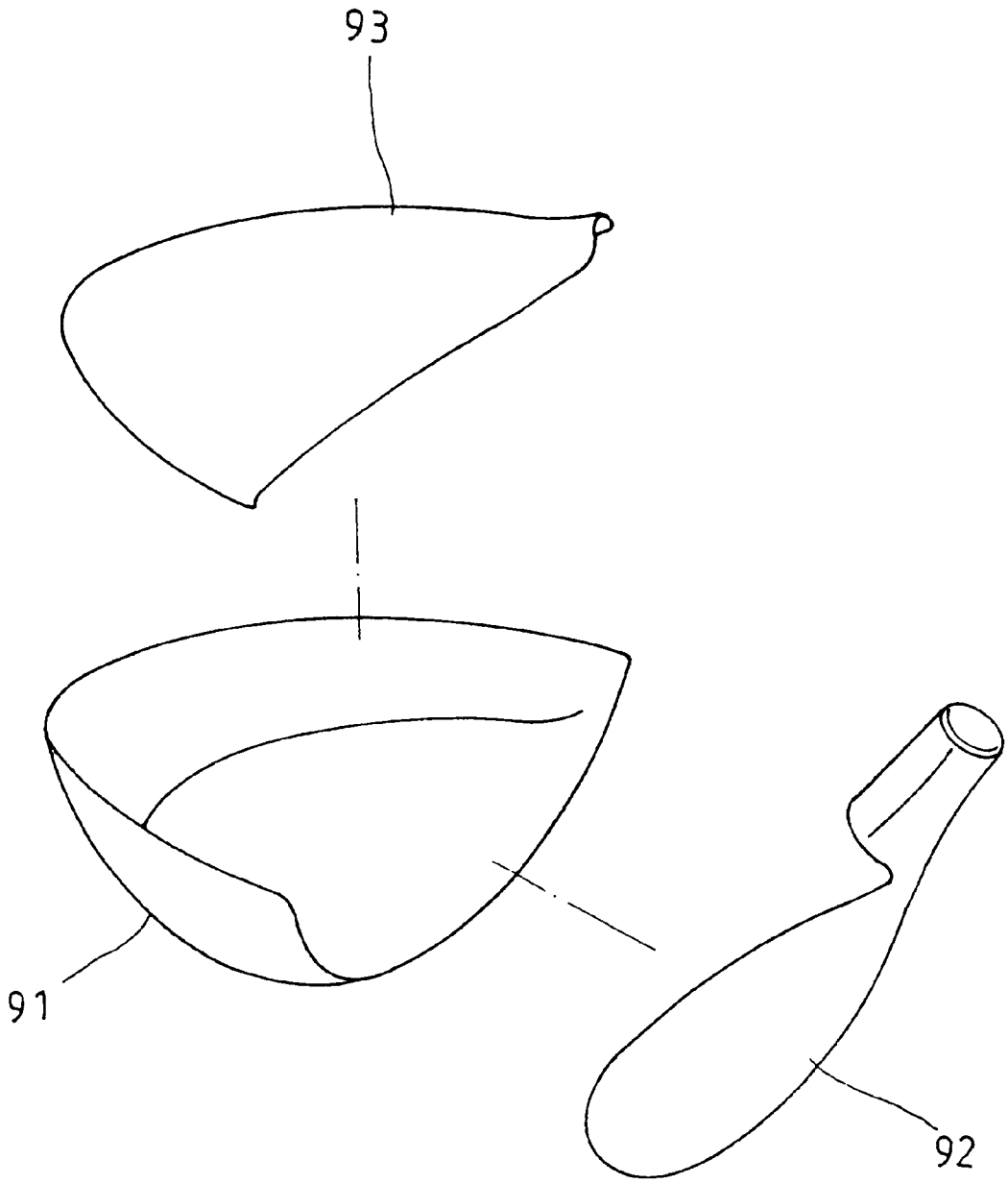
FIG. 1 (PRIOR ART)
FIG. 1 shows a schematic view of a wooden golf club head of the prior art.
Figure 2:
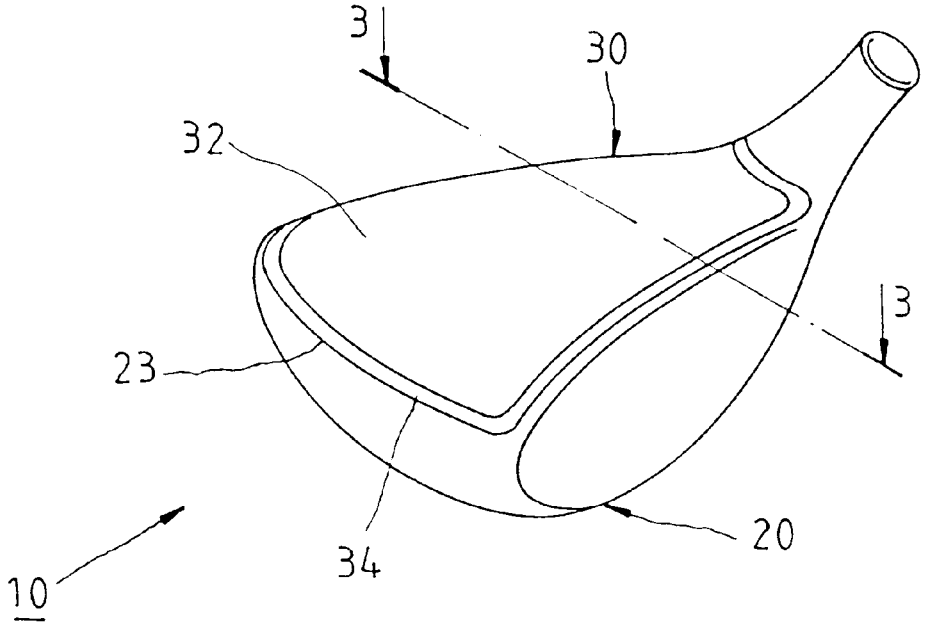
FIG. 2 shows a perspective view of a first preferred embodiment of the present invention.
Figure 3:
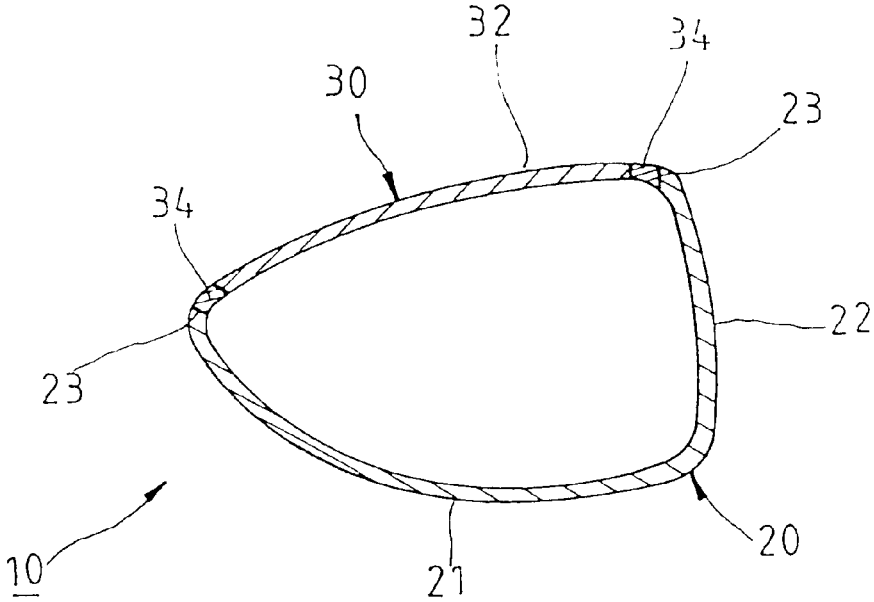
FIG. 3 shows a sectional view taken along the direction indicated by a line 3—3 as shown in FIG. 2.
Figure 4:
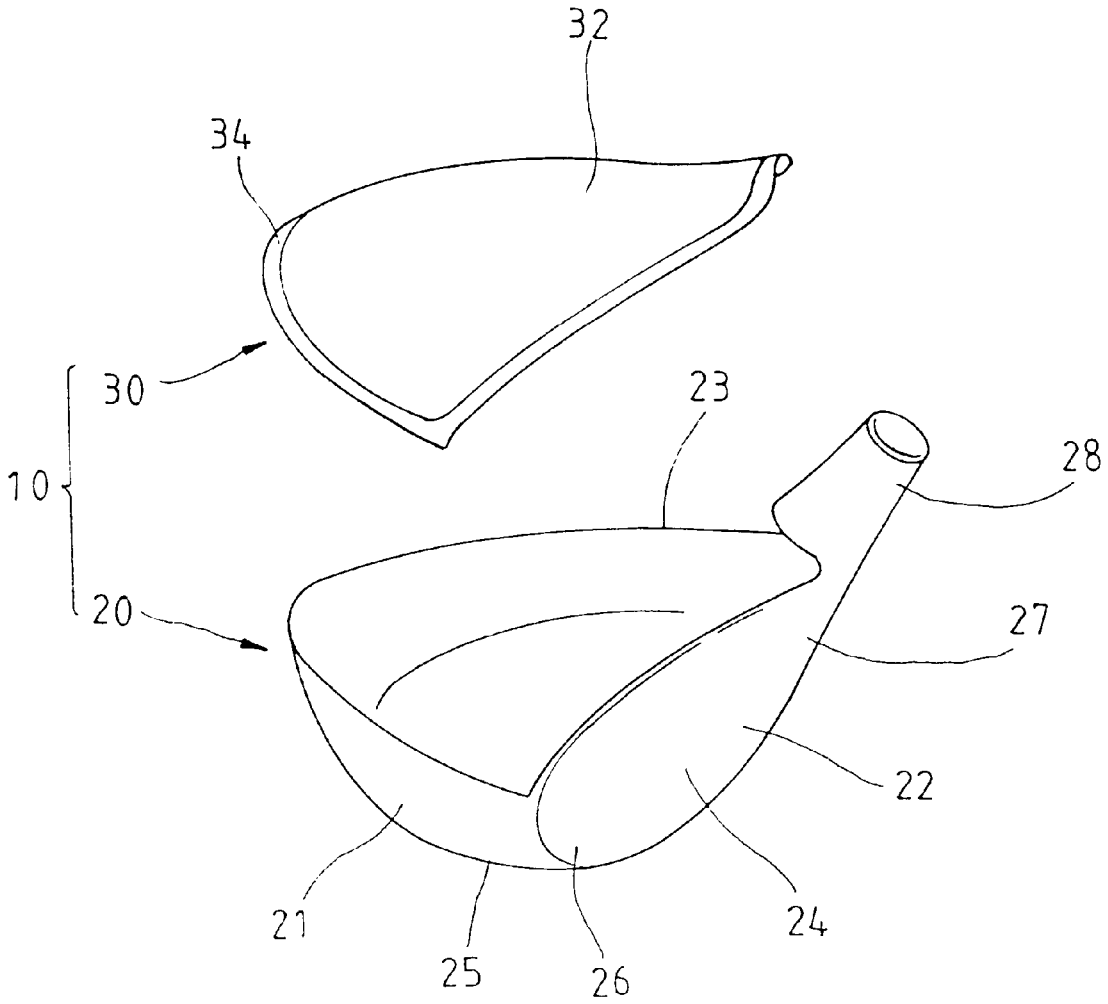
FIG. 4 shows a schematic view of the first preferred embodiment of the present invention in combination.

As shown in FIGS. 2–4, a wood-type golf club head 10 embodied in the present invention is formed of a main body 20 and a top shell 30 fastened with the top side of the main body 20 by welding.

The main body 20 is made of stainless steel and is shell-like in construction. The main body 20 is provided with a face 24, a sole 25, a toe portion 26, a heel 27, and a neck 28. The main body 20 is further provided in a top side thereof with a notch 23. The main body 20 is formed of a base shell 21 of stainless steel and a front shell piece 22 which is made of stainless steel and is fastened with the base shell 21 by welding.

The top shell 30 is of an arcuate construction and is corresponding in shape to the notch 23 of the main body 20. In other words, the hollow head 10 of the present invention is formed of the main body 20 and the top shell 30 which is joined with the notch 23 of the main body 20 by welding.

The head 10 of the present invention is characterized by the top shell 30 which is formed of a main piece 32 and an annular piece 34. The main piece 32 is made of a material different from the stainless steel of which the main body 20 is made. In other words, the main piece 32 is made of titanium. The annular piece 34 is made of a material identical with the material of which the main body 20 is made. In other words, the annular piece 34 is made of stainless steel.

Figure 5:
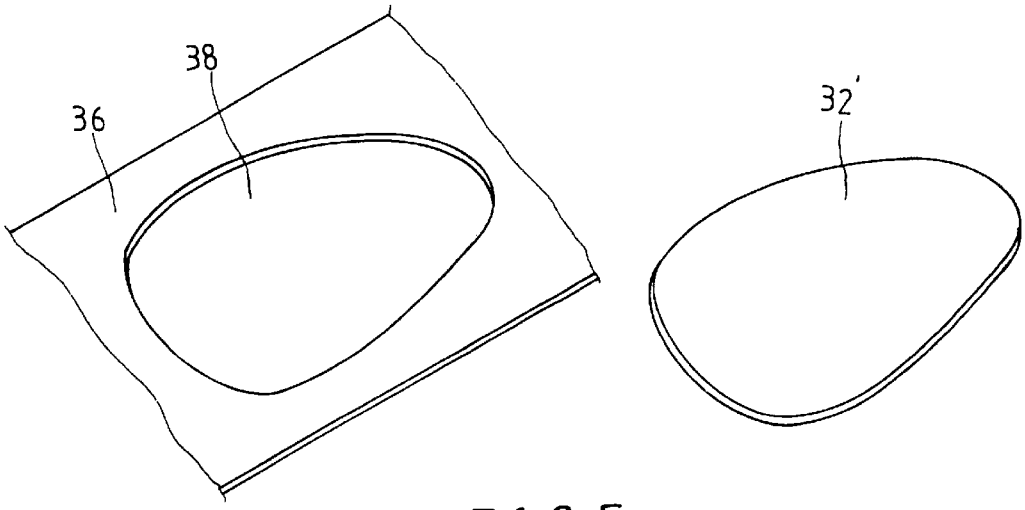
FIGS. 5–7 are schematic views showing the processes of making the top shell of the first preferred embodiment of the present invention.
Figure 6:
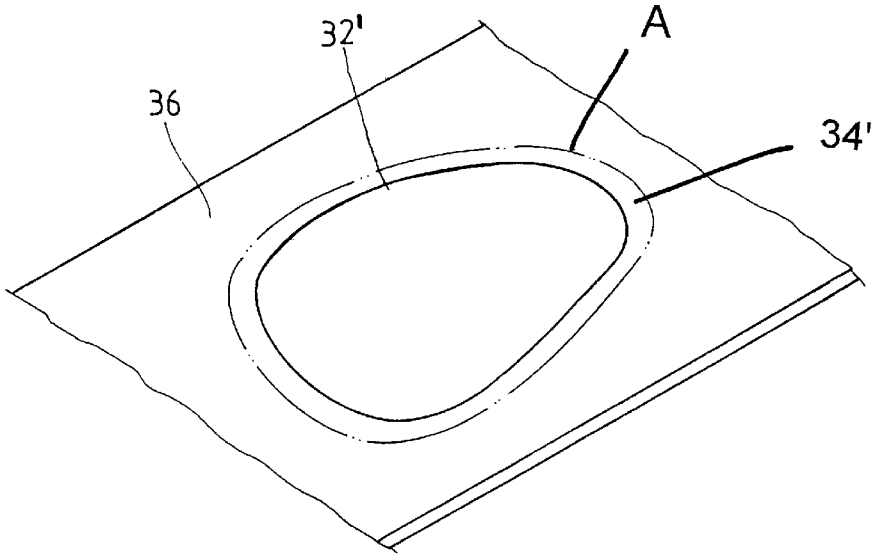
Figure 7:
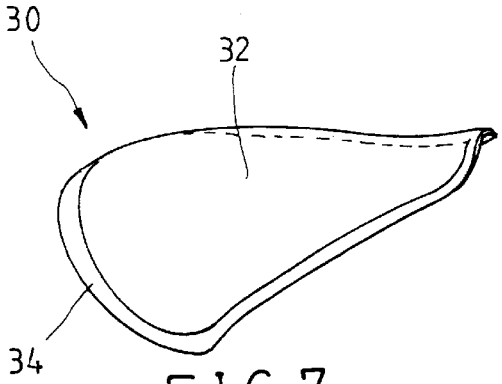

As illustrated in FIGS. 5–7, the top shell 30 comprising pieces 32 and 34 is provided by first forming a flat platelike main piece 32' from a titanium plate by punching and cutting such that the main piece 32' corresponds in profile to the notch 23. The main piece 32' is made slightly smaller than the notch 23. Next, an opening 38 is formed by punching in a flat stainless steel plate 36 such that the opening 38 corresponds in shape to the main piece 32', as shown in FIG. 5. Thereafter, the titanium main piece 32' is inlaid in opening 38 of the stainless steel plate 36 such that the main piece 32' is fused in the opening 38 by welding, as illustrated in FIG. 6. The arcuate top shell 30 is then made by cutting along the profile line A, as shown by the imaginary line in FIG. 6, which is 2–5 mm away from the outer edge of the main piece 32' to form annular piece 34. The curved surface of the arcuate top shell 30 is then made by pressing the flat plate comprising pieces 32' and 34'.

In view of the top shell 30 being joined with the notch 23 of the main body 20, the head 10 of the present invention has a center of gravity which is located at the lower portion of the head 10. In addition, the main piece 32 and the annular piece 34 are welded in notch 23 even though they are made of different materials. The welding of the top shell 30 and the main body 20 can be carried out easily in view of the welding portions of the main body 20 and the top shell 30 are made of the same material.

Figure 8:
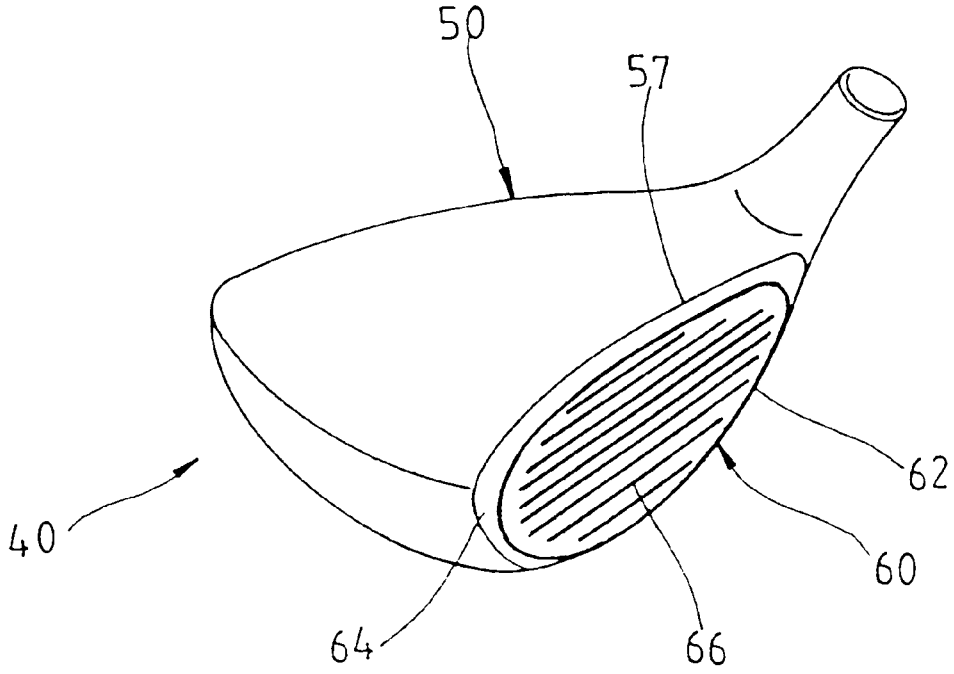
FIG. 8 shows a perspective view of a second preferred embodiment of the present invention.
Figure 9:
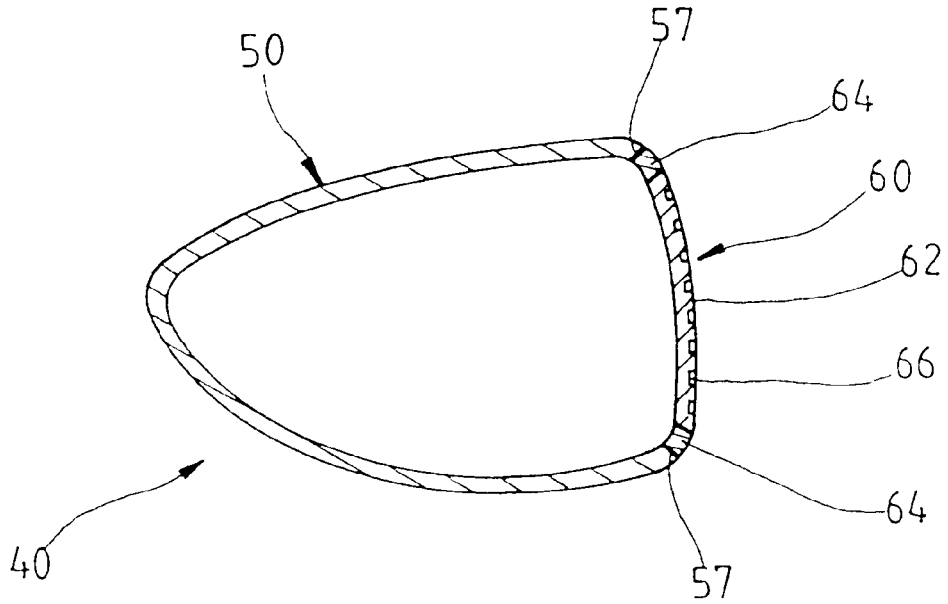
FIG. 9 shows a sectional view taken along the direction indicated by a line 9—9 as shown in FIG. 8.

As shown in FIGS. 8 and 9, a head 40 of another preferred embodiment of the present invention is formed of a main body 50 of stainless steel, and a front shell 60. The main body 50 is provided in the face thereof with a notch 57 in which the front shell 60 is welded. The front shell 60 is formed of a main piece 62 of titanium, and an arcuate piece 64 of stainless steel.

What is claimed is:

1. A wooden-type golf club head comprising a main body of a metal material provided with an annular notch, and an arcuate shell of a metal material joined with said notch by welding; wherein said arcuate shell is formed of an annular piece and a main piece, said annular piece being made of a material identical with said material of which said main body is made, said main piece being made of a material different from said material of which said main body is made, wherein said annular piece is provided with an opening in which said main piece is welded.

2. The wooden-type golf club head as defined in claim 1, wherein said material of which said main body is made has a specific gravity greater than a specific gravity of said material of which said main piece of said arcuate shell is made.

3. The wooden-type golf club head as defined in claim 1, wherein an inner wall enclosing the opening in said annular piece and an outer wall of said annular piece are separated from each other by a distance ranging between 2 mm and 5 mm.

4. The wooden-type golf club head as defined in claim 1, wherein said main body is made of stainless steel; and wherein said main piece of said arcuate shell is made of titanium.

5. The wooden-type golf club head as defined in claim 1, wherein said notch of said main body is located in said main body so as to correspond in location to the surface of the head.

* * * * *